United States Patent [19]

Mattheis

[11] 4,370,758

[45] Feb. 1, 1983

[54] SOUND ATTENUATOR FOR USE IN CONJUNCTION WITH THE MOTORCYCLE HELMET OR THE LIKE

[76] Inventor: Dale B. Mattheis, 10790 Falk Rd. NE., Bainbridge Island, Wash. 98110

[21] Appl. No.: 201,290

[22] Filed: Oct. 27, 1980

[51] Int. Cl.[3] ..... A42B 3/02

[52] U.S. Cl. ..... 2/423; 2/422

[58] Field of Search ..... 2/423, 424, 410, 422, 2/209, 10; 181/129

[56] References Cited

U.S. PATENT DOCUMENTS

| | | | |
|---|---|---|---|
| 2,901,751 | 9/1959 | Gales | 2/209 X |
| 3,548,410 | 12/1970 | Parker | 2/10 X |
| 4,103,359 | 8/1978 | Rieppel et al. | 2/209 X |

FOREIGN PATENT DOCUMENTS

| | | | |
|---|---|---|---|
| 810836 | 1/1937 | France | 2/209 |
| 479645 | 4/1953 | Italy | 2/209 |
| 210875 | 2/1924 | United Kingdom | 2/423 |

*Primary Examiner*—Peter P. Nerbun

*Attorney, Agent, or Firm*—Cole, Jensen & Puntigam

[57] ABSTRACT

A motorcycle helmet having a modified exterior configuration to attenuate noise generated when passing through the air. The modified helmet begins flaring outwardly from the traditional helmet configuration at a point adjacent to the chin of the wearer, terminates at a location generally behind the ear of the wearer and is spaced from the exterior shell of the helmet at the central portion of the rearward edge. The trailing edge of the sound attentuating device is open so that the wearer retains the ability to hear noises from behind and beside him.

6 Claims, 10 Drawing Figures

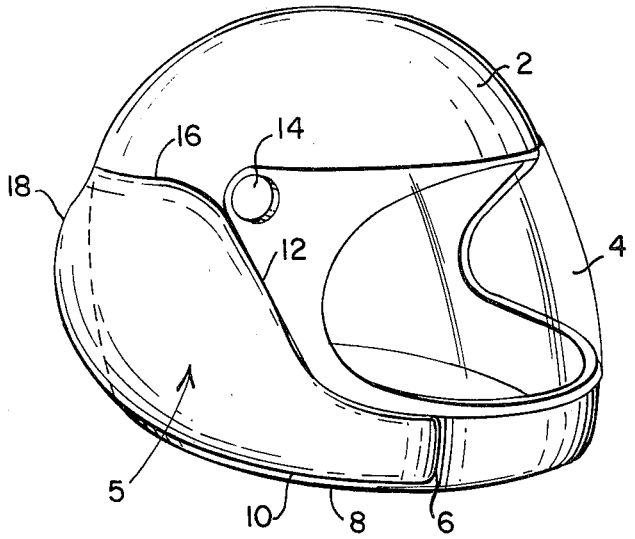
FIG. 1
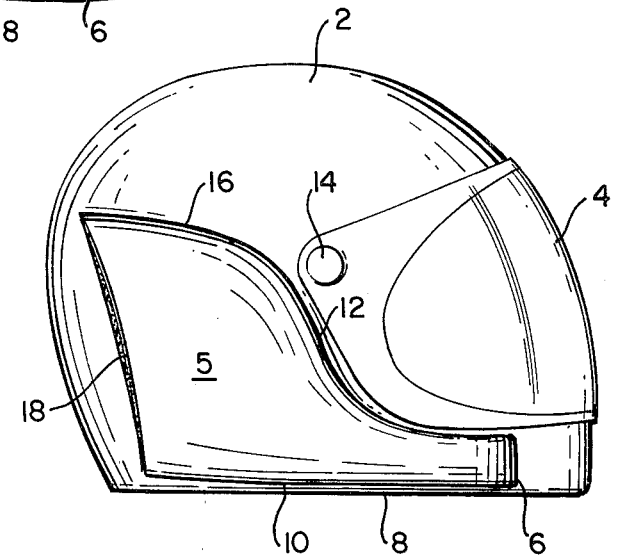
FIG. 2
FIG. 3
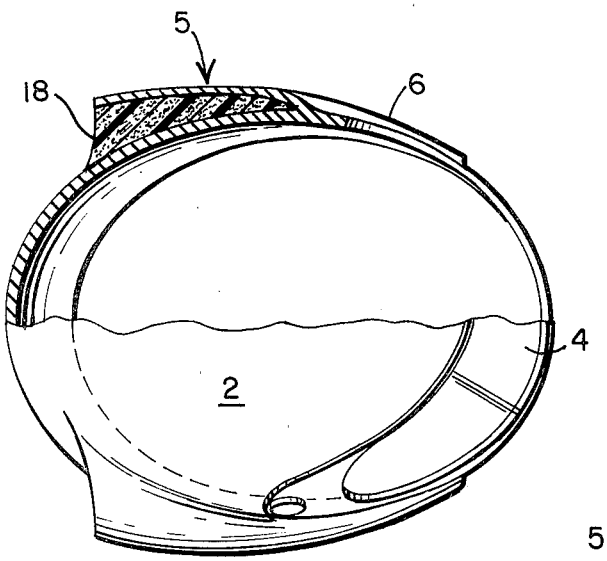
FIG. 4
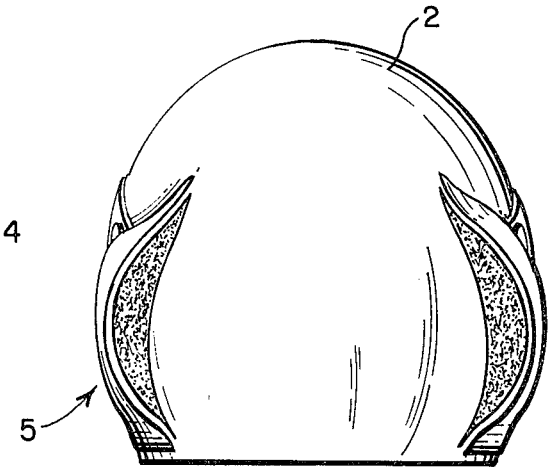

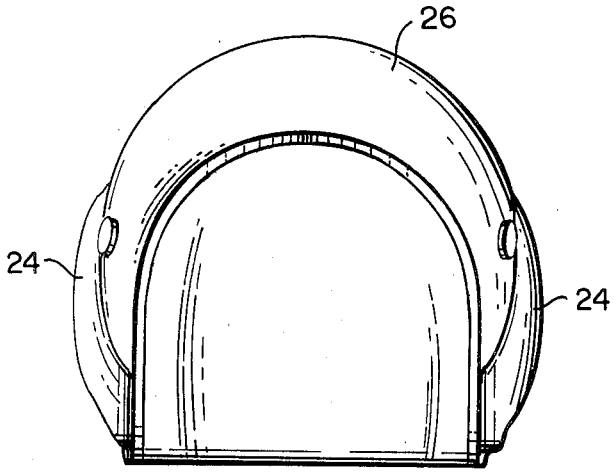
FIG. 8
FIG. 9
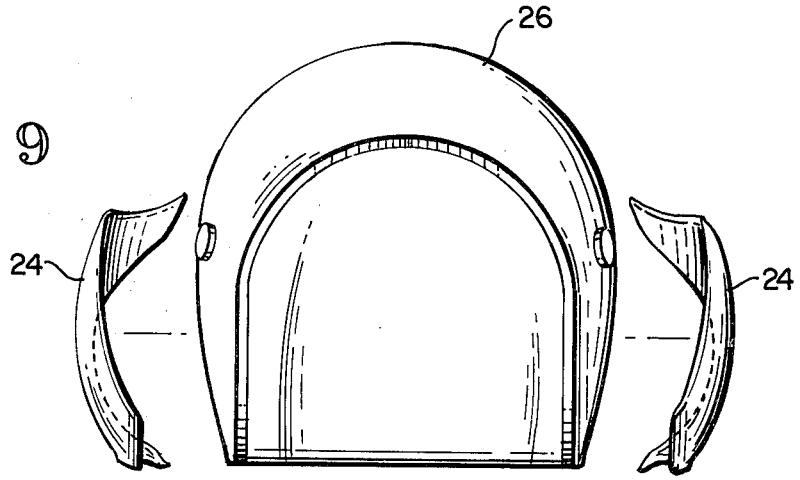
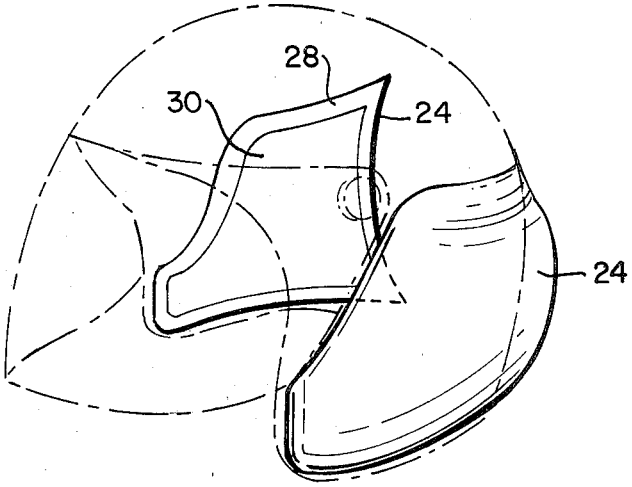
FIG. 10

SOUND ATTENUATOR FOR USE IN CONJUNCTION WITH THE MOTORCYCLE HELMET OR THE LIKE

BACKGROUND OF THE INVENTION

Serious motorcycle riders and those people concerned with safety fully agree that the utilization of a helmet while riding a motorcycle or the like is imperative. The people who ride the cycles often find the wearing of the helmet disagreeable in the fact that it is hot, somewhat restricts the vision, and further at high rates of speed generates a noise as it passes through the air. The noise is apparently caused or generated by the flow of the air along the sides of the helmet.

Because of the various inconveniences and discomforts of the helmet, it has been found that many riders refuse or neglect to wear the helmet resulting in a greater incidence of head injury from falls or the like. It is imperative therefore that every effort be made to construct and make available a helmet which is satisfactory to and comfortable for the rider thus removing as many objections to wearing the helmet as possible.

Helmets known to the inventor which deal with a variety of problems and configurations include the following:

U.S. Pat. No. 2,889,555 granted to Stuart et al June 9, 1959 which discloses a helmet to cover the major portion of the head with additional coverage means for use over the ear portion.

U.S. Pat. No. 3,102,538 granted to Cowan Sept. 3, 1963 discloses a pressure pod for use over the ears with a diving suit.

U.S. Pat. No. 3,178,723 granted to Aileo Apr. 20, 1965 includes a sound attenuating device for use within a rigid shell and in particular the means for supporting the attenuating device.

U.S. Pat. No. 3,400,406 granted to Aileo on Sept. 10, 1968 discloses a means for positioning sound attenuating devices on safety helmets.

U.S. Pat. No. 3,621,488 granted to Gales on Nov. 23, 1971 deals with a sound attenuating helmet including spring biased means for covering the ears within the helmet.

U.S. Pat. No. 3,423,759 granted to Catroppa et al on Jan. 28, 1969 deals with specific sound attenuating devices for use in helmets for helicopter pilots or the like.

U.S. Pat. No. 3,568,211 granted to Petruzella, Jr. on Mar. 9, 1971 discloses a dual visor helmet including an ear cup.

U.S. Pat. No. 3,778,844 granted to Hori et al on Dec. 18, 1973 discloses a helmet for utilization on a motorcycle or the like including a means to prevent the whistling noise normally heard at the hearing openings in helmets of this design.

U.S. Pat. No. 4,075,715 granted to Cowgills on Feb. 28, 1978 discloses an anti-lift device for use in conjunction with a helmet.

U.S. Design Pat. No. 241,888 granted to Lipper on Oct. 19, 1976 shows the design of a helmet.

U.S. Design Patent No. 242,088 granted to Durand et al on Nov. 2, 1976 discloses yet another design for helmet.

With the above noted prior art and deficiencies in mind, it is an object of the present invention to provide a modified helmet designed primarily for use upon a motorcycle. The traditional motorcycle type helmets currently in use were initially designed as crash helmets and not particularly designed for use in moving air. The present inventive helmet is stylized and designed to abate the noise caused by turbulence and/or laminar flow as the helmet passes through the air.

It is another object of the present invention to provide a noise attenuating modification for helmets which is attractive in appearance, is streamlined and further does not reduce or alter the integrity of the helmet itself.

Still a further object of the present invention is to provide a separate, attachable modification to a motorcycle helmet wherein the modification is in two parts which are applied to the exterior of a standard manufactured helmet. When the appliques are applied, they reduce the high pitched noise from laminer flow as well as any noise caused by turbulence. The attachment includes, within a flexible resilient outwardly extending shell, which alters the air flow an insulative or sound absorbing material.

Yet another object of the present invention is to provide a means to break up the laminer flow of air over a motorcycle helmet, reduce the noise from excessive turbulence and yet to allow the wearer to have the ability to hear noises from the side or the rear.

Still another object of the present invention is to provide a modification to motorcycle helmets which is designed in a shape that does not of itself, create an excessively turbulent flow and further channels or creates a smooth, noise-reduced exit of air, subjected to laminer flow, as it passes over the helmet.

BRIEF DESCRIPTION OF THE DRAWINGS

FIG. 1 is a pictorial representation of a full motorcycle helmet with the inventive noise attenuator in position.

FIG. 2 is a side elevation of the helmet in FIG. 1.

FIG. 3 is a top view, partially cut away, of the helmet in FIG. 1.

FIG. 4 is a rear view of the helmet in FIG. 1.

FIG. 8 is a front view of the helmet of FIG. 6.

FIG. 9 is an exploded front view of the helmet in FIG. 6.

FIG. 10 is a pictorial representation of the applique per se with the helmet shown in phantom.

DETAILED DESCRIPTION OF THE DRAWINGS

Figure 5:
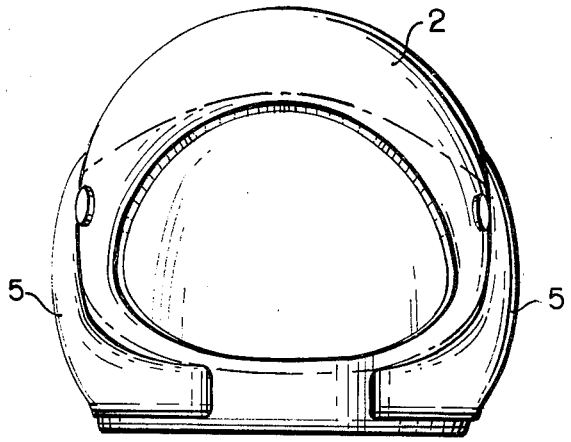
FIG. 5 is a front view of the helmet of FIG. 1.

As seen in FIG. 1, a standard full helmet is shown with a visor 4 in position. The inventive, sound attenuating/laminer flow dispersing device extends from a forwardmost position at 6 where it is relatively narrow, fitting along the chin bar, and thin to provide an aerodynamic device, and extends rearwardly along the base of the helmet as at 10 and includes a top portion which curves upwardly along a line 12 which generally conforms to the outer configuration of the visor 4. It is important to note that the exterior design of the modified helmet is such that there is a smooth flow of air both when the operator is facing forward and when looking sideways. At a point adjacent the pivot point 14 of the visor 4, the upper surface of the sound attenuating device flows rearwardly as along 16 to terminate generally behind the ear of the wearer having a substantially vertical but curved rearwardmost edge 18.

Referring now to FIG. 2, the same basic elements and a different view of the helmet can be seen and it further can be seen that the rearward edge 18 is generally rearwardly of the normal position of the ear of the wearer and terminates in a smooth multi-dimensional curved surface.

Referring now to FIGS. 3 and 4, it can be seen that the outwardly flaring extension 5 is open at the rear 18 but extends smoothly and evenly from the forward portion 6 to the rearward portion to terminate at the edge 18. The necessity of presenting an aerodynamically clean surface to the passing air cannot be overstressed. Any unplanned interruption in the surface may generate excessive turbulence and noise. A separate but interrelated voice which must be addressed is the high pitched noise created by laminar flow. To reduce this noise, a minor turbulence is permitted to exist. At this point in time, it would appear that our technology does not permit the complete elimination of noise and therefore, we strive to reduce or eliminate the more offensive noises. It is to be noted that the interior of the space between the helmet shell 2 and the device 5 may be filled with an insulative device to further absorb any excess noise.

As seen in FIGS. 1–5, the extensions on either side of the helmet are mounted upon or integrally molded as a part of the helmet 2 and are aerodynamically configured to maintain original design laminar flow, minimize excessive turbulence and absorb noise.

Figure 6:
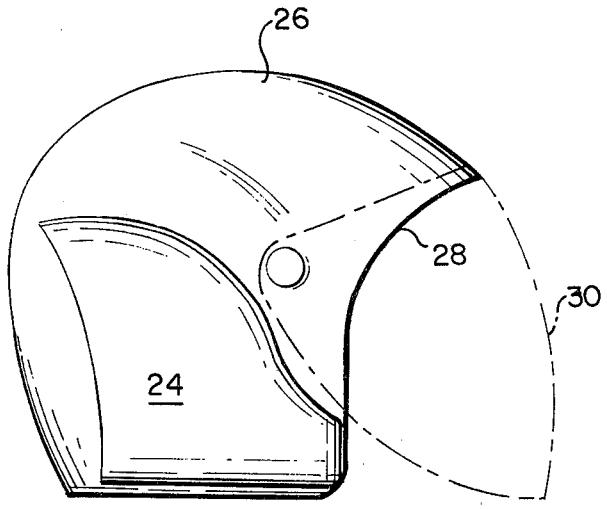
FIG. 6 is a side elevational view of a cutaway helmet.
Figure 7:
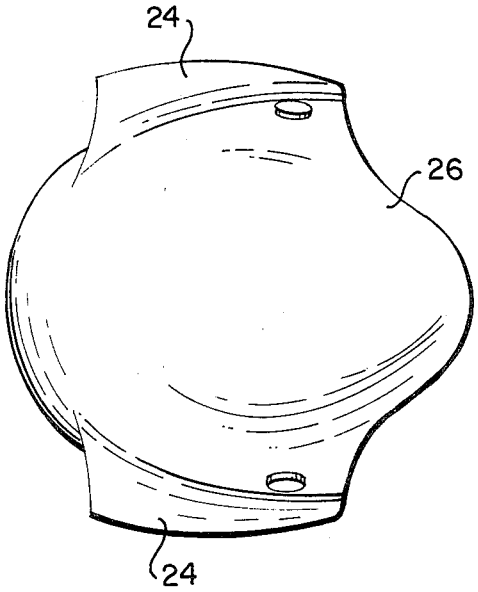
FIG. 7 is a top view of the helmet of FIG. 6.

Referring now to FIGS. 6, 7 and 8, a similar device 24 having the modulating extensions is mounted upon a cutaway helmet 26 and although the modulating extensions are necessarily foreshortened, the result is substantially identical. It is to be noted that the cutaway helmet includes opening 28 and visor 30.

As seen in FIG. 8, a helmet of FIG. 6 as seen from the front and including the extensions or additions 24 becomes a bit broader, however, and it is to be noted that when the helmet is turned such that its side is to the wind such as when the cyclist is looking over his shoulder or looking for traffic, the helmet is more aerodynamically sound and does not create as great a stress on the neck or discomfort to the wearer.

Referring to FIG. 9, it can be seen that an alternative modification of the present invention includes appliques 24 which may be adhesively secured to helmet 26 in a manner known in the art.

The applique 24 itself as seen in FIG. 10, includes contoured upper and lower portions having an inwardly facing contact surface 28 along a major part of the edge which can be adhesively secured to the helmet. As seen in this view, insulation 30 could be included to absorb some of the noise.

Thus, as can be seen, an alteration of the exterior helmet configuration by the present invention greatly improves the aerodynamics, reduces noise and thus resistance to wear.

What is claimed is:

1. An attachment for motorcycle helmets or the like, comprising:

a pair of similar premolded outwardly flaring, contour changing members, one to be attached to each side of the preformed helmet shell, each of said members configured such that the interior peripheral surface around a majority of the members conforms to the helmet surface and is adapted to be sealingly secured thereagainst and having an exterior surface that smoothly flows from a foremost position adjacent the chin of a wearer whereat it is relatively shallow and narrow to a rearwardmost position generally covering the ear of the wearer, spaced from the helmet surface and extending from adjacent the bottom of the helmet to a position generally above and behind the ear of the wearer.

2. A motorcycle helmet which reduces the noise created by passing wind without lessening the ability of a rider to hear comprising:

a rigid exterior shell approximating the shape of a wearers head and including the necessary padding or other attachments to provide safety and comfort, outwardly extending helmet configuring elements extending along each side of the helmet and forming a smooth surface therealong, said elements forming a contoured smoothly flowing leading portion which extends rearwardly while simultaneously becoming more prominent along the horizontal and vertical dimensions of the helmet and terminating at a position normally behind the ear of the wearer in a flared open condition generally reducing noise created while passing through the wind and yet permitting entry of traffic noise.

3. An attachment as in claim 1, wherein the interior of the contour changing members includes a sound absorbing material.

4. An attachment as in claim 1, wherein the helmet does not extend over the chin and the attachment is secured adjacent the lowermost front edge thereof.

5. An attachment as in claim 1, wherein the elements includes relatively flat edges to conform to and be adhesively attached to the exterior of the helmet.

6. An attachment as in claim 2, wherein the interior of the helmet configuring elements includes a sound absorbing material.

* * * * *